US006062947A

United States Patent [19]

Obayashi et al.

[11] Patent Number: 6,062,947

[45] Date of Patent: May 16, 2000

[54] LENS GRINDING APPARATUS

[75] Inventors: Hirokatsu Obayashi; Ryoji Shibata, both of Aichi, Japan

[73] Assignee: Nidek Co., Ltd., Aichi, Japan

[21] Appl. No.: 09/112,010

[22] Filed: Jul. 8, 1998

[30] Foreign Application Priority Data

Jul. 8, 1997 [JP] Japan ..... 9-199227

[51] Int. Cl.[7] ..... B24B 49/00

[52] U.S. Cl. ..... 451/5; 451/255; 451/43

[58] Field of Search ..... 451/5, 10, 14, 451/43, 195, 197, 209, 210, 255, 256, 42

[56] References Cited

U.S. PATENT DOCUMENTS

| | | | |
|---|---|---|---|
| 5,138,770 | 8/1992 | Matsuyama | 33/28 |
| 5,152,067 | 10/1992 | Kurachi et al. | 33/200 |
| 5,161,333 | 11/1992 | Lecerf et al. | 451/21 |
| 5,228,242 | 7/1993 | Matsuyama | 51/165.74 |
| 5,333,412 | 8/1994 | Matsuyama | 51/165.71 |
| 5,347,762 | 9/1994 | Shibata et al. | 451/15 |
| 5,363,597 | 11/1994 | Gottschald et al. | 451/69 |
| 5,450,335 | 9/1995 | Kikuchi | 702/168 |
| 5,630,746 | 5/1997 | Gottschald et al. | 451/5 |
| 5,716,256 | 2/1998 | Mizuno et al. | 451/5 |
| 5,727,987 | 3/1998 | Gottschald | 451/5 |
| 5,775,973 | 7/1998 | Watanabe | 451/5 |
| 5,803,793 | 9/1998 | Mizuno et al. | 451/5 |
| 5,890,949 | 4/1999 | Shibata | 451/5 |
| 5,904,613 | 5/1999 | Luderich | 451/255 |

FOREIGN PATENT DOCUMENTS

| | | | |
|---|---|---|---|
| 0 379 426 A2 | 7/1990 | European Pat. Off. . | |
| 0 479 683 A2 | 4/1992 | European Pat. Off. . | |
| 0510462 | 10/1992 | European Pat. Off. . | |
| 1271156 | 10/1989 | Japan . | |
| 0215960 | 1/1990 | Japan . | |
| 0265960 | 3/1990 | Japan . | |
| 0265961 | 3/1990 | Japan . | |
| 2152759 | 6/1990 | Japan . | |
| 0320603 | 1/1991 | Japan . | |
| 7186025 | 7/1995 | Japan . | |
| 9-254000 | 9/1997 | Japan | 451/5 |

*Primary Examiner*—Rodney Butler

*Attorney, Agent, or Firm*—Sughrue, Mion, Zinn, Macpeak & Seas, PLLC

[57] ABSTRACT

In a lens grinding apparatus, shape data of an eyeglass frame and layout data of an eyeglass lens for the eyeglass frame are input. Edge positions of front and rear surfaces of the eyeglass lens are measured on the basis of the input data. The position variation information of the front and rear surfaces of the lens with respect to a radius vector is input. An inclination angle of a finishing grinding wheel is stored. Edge positions after a finishing process are calculated on the basis of the measured edge positions, the input position variation information, and the inclination angle of the finishing grinding wheel. A chamfering grinding wheel for chamfering edge portions of a finish-processed eyeglass lens is controlled on the basis of the edge positions obtained by the edge position calculation. A chamfering process is easily performed, and particularly chamfering is uniformly performed.

5 Claims, 14 Drawing Sheets

LENS GRINDING APPARATUS

BACKGROUND OF THE INVENTION

The present invention relates to a lens grinding apparatus which grinds the periphery of an eyeglass lens.

An apparatus is known which grinds an eyeglass lens so that it fits into an eyeglass frame. In an optician's shop, an optician processes the periphery of each eyeglass lens so as to make the periphery coincident with the shape of an eyeglass frame selected by the customer, to form a bevel or a groove, and then mounts the processed lens into the frame. The thus grounded lens has an angular portion at front and rear ends of the edge. If such angular portions are left intact, they may possibly hurt the user or become a cause of crack or breakage of the lens. Therefore, it is common practice for lens processors to chamfer edge portions.

Conventionally, such chamfering is performed with a hand grinder having a rotating grinding wheel bounded by conical slope, and the optician who holds a lens urges its edge into contact with the chamfering grinding wheel and chamfers edge portions to give a desired shape under visual checking.

However, such a chamfering operation with a hand grinder requires skill and is not easy to perform. For an unskilled optician, the operation is time-consuming and does not guarantee grinding to the intended shape. Furthermore, chamfering constitutes an important factor in appearance.

SUMMARY OF THE INVENTION

In view of the problems, it is an object of the invention to provide a lens grinding apparatus with which a chamfering process can be easily performed to a desired shape and particularly chamfering can be uniformly performed.

In order to attain the object, the invention is characterized in that the apparatus has the following configuration.

(1) A lens grinding apparatus for grinding the periphery of an eyeglass lens, comprising:

data inputting means for inputting shape data of an eyeglass frame and layout data of an eyeglass lens to the eyeglass frame;

edge position measuring means for measuring edge positions of front and rear surfaces of the eyeglass lens on the basis of the input data;

position variation information inputting means for inputting position variation information of the front and rear surfaces of the lens with respect to a radius vector;

inclination angle storing means for storing an inclination angle of a finishing grinding wheel;

edge position calculating means for calculating edge positions after a finishing process on the basis of the measured edge positions, the input position variation information, and the inclination angle of the finishing grinding wheel;

chamfering means which has a chamfering grinding wheel for chamfering edge portions of a finish-processed eyeglass lens and which moves a shaft of the chamfering grinding wheel relative to a shaft holding the eyeglass lens; and chamfering process controlling means for controlling an operation of the chamfering means on the basis of the edge positions calculated by the edge position calculating means.

(2) A lens grinding apparatus according to (1), wherein the position variation information is lens data of the eyeglass lens or edge position information obtained by measuring different positions with respect to the radius vector by the edge position measuring means.

(3) A lens grinding apparatus according to (1), further comprising:

measurement position calculating means for calculating at least first and second measurement positions for measuring edge positions of the same one of the front and rear surfaces of the eyeglass lens on the basis of the data input through the data input means, wherein the position variation information is obtained from a measurement result of the edge position measuring means in accordance with measurement positions calculated by the measurement position calculating means.

(4) A lens grinding apparatus according to (1), further comprising:

inclination angle correcting means for correcting the inclination angle of the finishing grinding wheel stored in the inclination angle storing means, on the basis of a positional relationship between a process point of the finishing grinding wheel and a rotation center of the lens.

(5) A lens grinding apparatus according to (1), further comprising:

finishing process calculating means for calculating data of a finishing process by the finishing grinding wheel, on the basis of the data input through the data inputting means and the edge positions measured by the edge position measuring means, wherein the edge position calculating means calculates edge positions after the finishing process, on the basis of the finishing process data.

(6) A lens grinding apparatus according to (5), wherein the finishing grinding wheel is a bevel grinding wheel for a beveling process, the finishing process data calculated by the finishing process calculating means include bevel apex locus data, the apparatus further comprises peripheral length correction calculating means for correcting a peripheral length of the bevel apex locus so as to substantially coincide with a peripheral length of the eyeglass frame input through the data inputting means, and wherein the edge position calculating means calculates the edge positions after a finishing process on the basis of a result calculated by the peripheral length correction calculating means.

(7) A lens grinding apparatus according to (1), further comprising:

chamfering amount instructing means for instructing a fixed chamfering amount; and chamfering process position calculating means for calculating a chamfering process position where a length of chamfered slope after a chamfering process becomes substantially constant regardless of the radius vector angle, on the basis of the instructed chamfering amount, information of edge position calculated by the edge position calculating means, and an inclination angle of the chamfering grinding wheel, and wherein the chamfering process controlling means controls an operation of the chamfering means on the basis of the chamfering process position obtained by the chamfering process position calculating means.

(8) A lens grinding apparatus according to (7), wherein the chamfering process position calculating means calculates the chamfering process position while using, as a reference, a length of the chamfered slope assumed under a condition that a lens whose lens surface has a predetermined inclination angle is subjected to the chamfering process.

(9) A lens grinding apparatus for grinding a periphery of an eyeglass lens, comprising:

data inputting means for inputting shape data of an eyeglass frame and layout data of an eyeglass lens to the eyeglass frame;

first calculating means for calculating at least first and second measurement positions for measuring edge positions of the same one of front and rear surfaces of the eyeglass lens, on the basis of the input data;

edge position measuring means for measuring edge positions of the eyeglass lens, in accordance with the first and second measurement positions calculated by the first calculating means;

second calculating means for calculating finishing process data for the eyeglass lens on the basis of information of the edge position measured by the edge position measuring means and the data input through the data inputting means;

inclination angle storing means for storing an inclination angle of a finishing grinding wheel;

a third calculating means for calculating edge positions after the finishing process on the basis of the measured edge position information, the calculated finishing process data, and the inclination angle of the finishing grinding wheel;

chamfering means which has a chamfering grinding wheel for chamfering edge portions of a finish-processed eyeglass lens and which moves a shaft of the chamfering grinding wheel relative to a shaft holding the eyeglass lens;

a fourth calculating means for calculating a position of the chamfering process by the chamfering means on the basis of the edge positions calculated by the third calculating means; and chamfering process controlling means for controlling an operation of the chamfering means on the basis of a result of the calculation of the fourth calculating means.

(10) A lens grinding apparatus comprising:

a finishing grinding wheel having a finishing conical surface inclined at a first predetermined angle with respect to a grinding wheel rotation axis;

a chamfering grinding wheel coaxial arranged with respect the finishing grinding wheel and having a chamfering conical surface inclined at a second predetermined angle with respect to the grinding wheel rotation axis;

a shaft which rotatively holds an eyeglass lens about a lens rotating axis;

a memory which stores therein a program that calculates:

a) first correction angles of the first predetermined angle, each of the first correction angles corresponding to an angle of the finishing conical surface in a cross-section taken along a reference line connecting a processing point at a respective radius vector angle to the lens rotation axis;

b) a locus of edge positions of the eyeglass lens processed by the finishing conical surface, each of the edge positions being determined in relation to a respective first correction angle in a cross-section taken along a reference line connecting a processing point at a respective radius vector angle to the lens rotation axis;

c) second correction angles of the second predetermined angle, each of the second correction angles corresponding to an angle of the chamfering conical surface in a cross-section taken along a reference line connecting an edge position on the locus at a respective radius vector angle to the lens rotation axis; and d) a locus of chamfering process points of the eyeglass lens processed by the chamfering conical surface, each of the chamfering process points being determined in relation to a respective second correction angle in a cross-section taken along a reference line connecting an edge position at a respective radius vector angle to the lens rotation axis; and a controller which controls a distance between the grinding wheel rotation axis and the lens rotation axis on the basis of the locus of edge positions and the locus of the chamfering process points.

(11) A lens grinding apparatus according to (10), wherein the program calculates the locus of edge positions by modifying each of the edge positions with a correction amount occurring in a cross-section taken along a reference line connecting a processing point at a respective radius vector angle to the lens rotation axis when a peripheral length correction is made along a line connecting the grinding wheel rotation axis to the lens rotation axis.

The present disclosure relates to the subject matter contained in Japanese patent application No. Hei. 9-199227 (filed on Jul. 8, 1997) which is expressly incorporated herein by reference in its entirety.

DESCRIPTION OF THE PREFERRED EMBODIMENT

A lens grinding apparatus according to an embodiment of the present invention will be hereinafter described with reference to the accompanying drawings.

Configuration of Whole Apparatus

Figure 1:
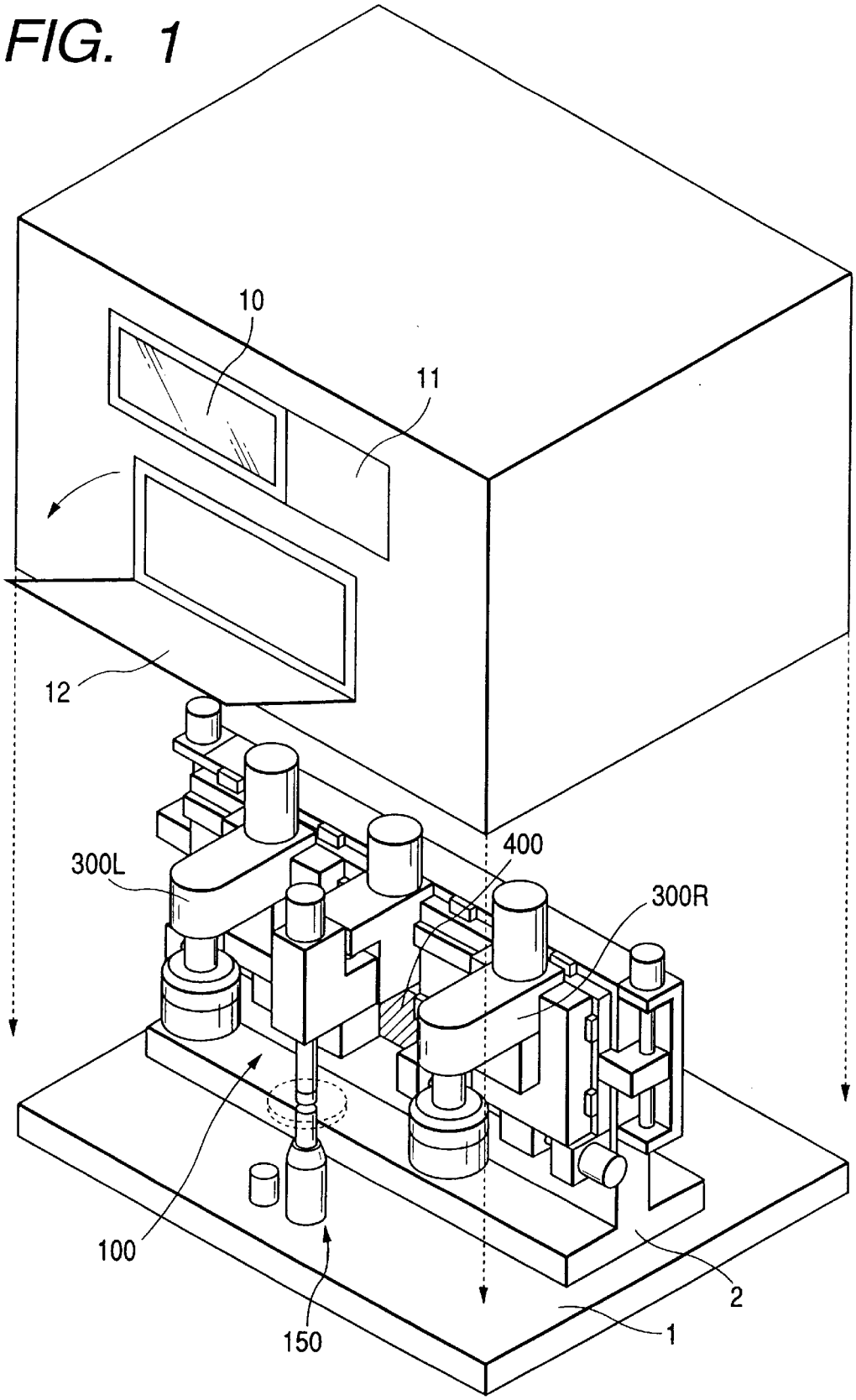
FIG. 1 is a diagram illustrating the general configuration of the apparatus.

In FIG. 1, reference numeral 1 denotes a main base, and 2 denotes a sub-base that is fixed to the main base 1. A lens chuck upper part 100 and a lens chuck lower part 150 hold a lens to be processed by means of their respective chuck shafts during processing it. A lens thickness measuring section 400 is accommodated below the lens chuck upper part 100 in the depth of the sub-base 2.

Figure 2:
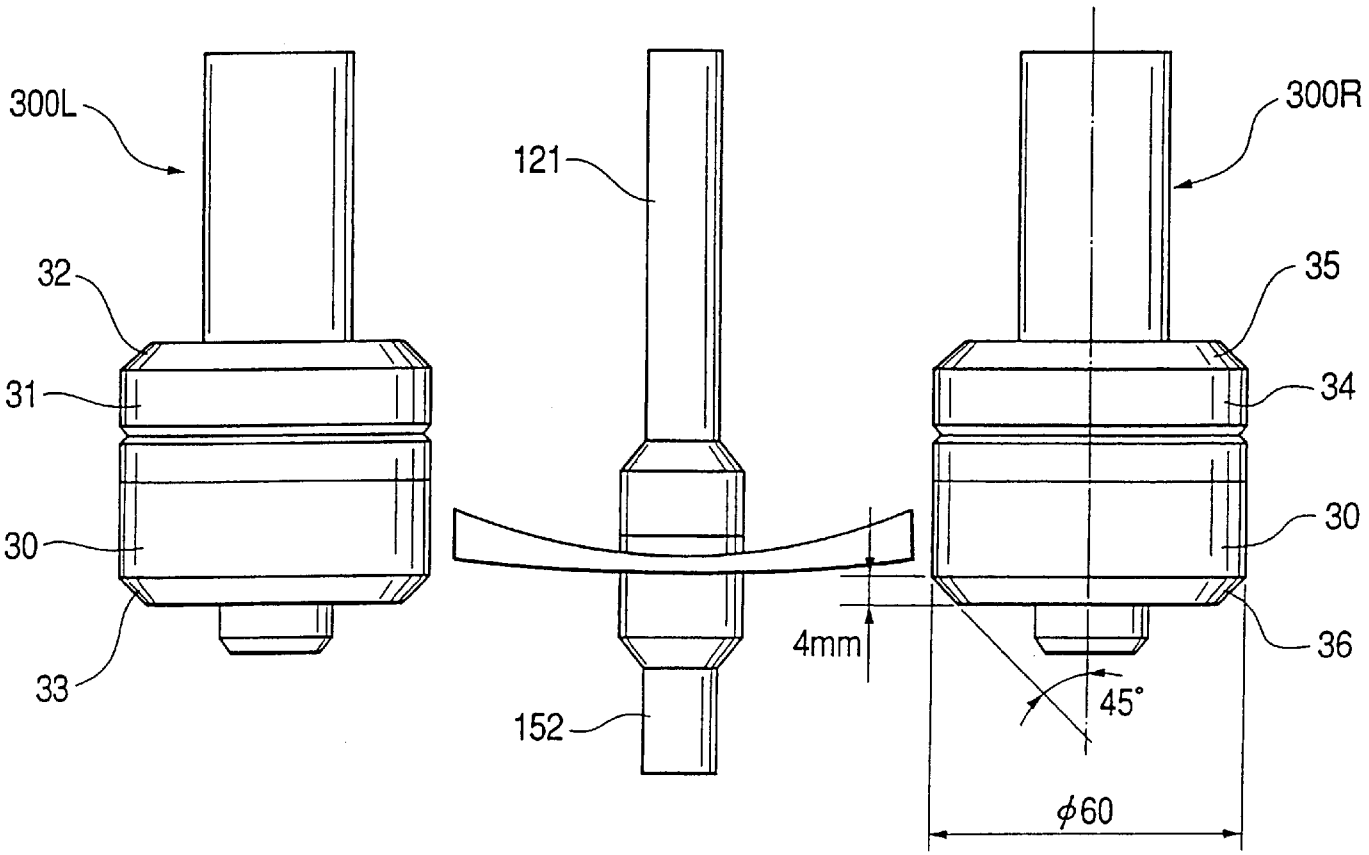
FIG. 2 is a diagram illustrating the configuration of grinding wheels in the apparatus of the embodiment.

Reference symbols 300R and 300L respectively represent right and left lens grinding parts each having grinding wheels for lens grinding on its rotary shaft. Each of the lens grinding parts 300R and 300L is held by a moving mechanism (described later) so as to be movable in the vertical and horizontal directions with respect to the sub-base 2. As shown in FIG. 2, a rough grinding wheel 30 and a finishing grinding wheel 31 having a bevel groove are mounted on the rotary shaft of the lens grinding part 300L. Further, a front surface chamfering grinding wheel 32 having a conical surface is coaxially attached to the upper end surface of the finishing grinding wheel 31, while a rear surface chamfering grinding wheel 33 having a conical surface is coaxially attached to the lower end surface of the rough grinding wheel 30. On the other hand, a rough grinding wheel 30, a mirror-finishing (polishing) grinding wheel 34 having a bevel groove, a front surface mirror-chamfering grinding wheel 35 having a conical surface, and a rear surface mirror-chamfering grinding wheel 36 having a conical surface are mounted on the rotary shaft of the lens grinding part 300R coaxially. The diameter of these grinding wheels are relatively small, that is, about 60 mm. The chamfering surface of each of the chamfering grinding wheels 32, 33, 35 and 36 is 4 mm in height and 45° in inclination.

A display unit 10 for displaying processing data and other information and an input unit 11 for allowing a user to input data or an instruction to the lens grinding apparatus are provided in the front surface of a body of the apparatus. Reference numeral 12 denotes a closable door.

Structures of Main Parts

<Lens Chuck Part>

Figure 3:
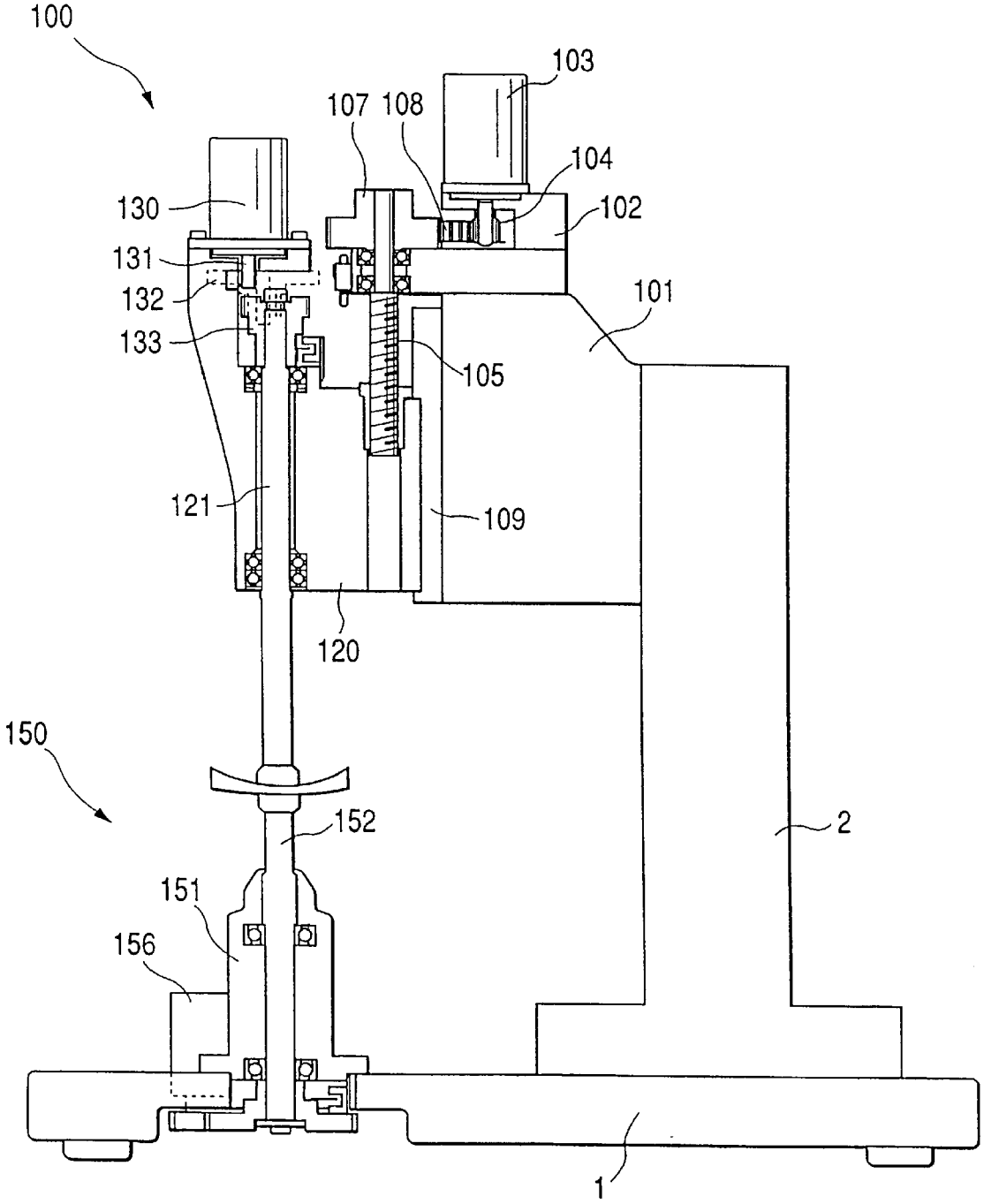
FIG. 3 is a view illustrating upper and lower parts of a lens chuck.

FIG. 3 illustrates the lens chuck upper part 100 and the lens chuck lower part 150. A fixing block 101 is fixed to the sub-base 2. A DC motor 103 is mounted on top of the fixing block 101 by means of a mounting plate 102. The rotational force of the DC motor 103 is transmitted through a pulley 104, a timing belt 108 and a pulley 107 to a feed screw 105. As the feed screw 105 is rotated, a chuck shaft holder 120 is vertically moved while being guided by a guide rail 109 fixed to the fixing block 101. A pulse motor 130 is fixed to the top portion of the chuck shaft holder 120, so that the rotational force of the pulse motor 130 is transmitted via a gear 131 and a relay gear 132 to a gear 133 to rotate the chuck shaft 121.

A lower chuck shaft 152 is rotatably held by a chuck shaft holder 151 fixed to the main base 1. The rotational force of a pulse motor 156 is transmitted to the chuck shaft 152 to rotate the chuck shaft 152.

<Moving Mechanism for Lens Grinding Part>

Figure 4:
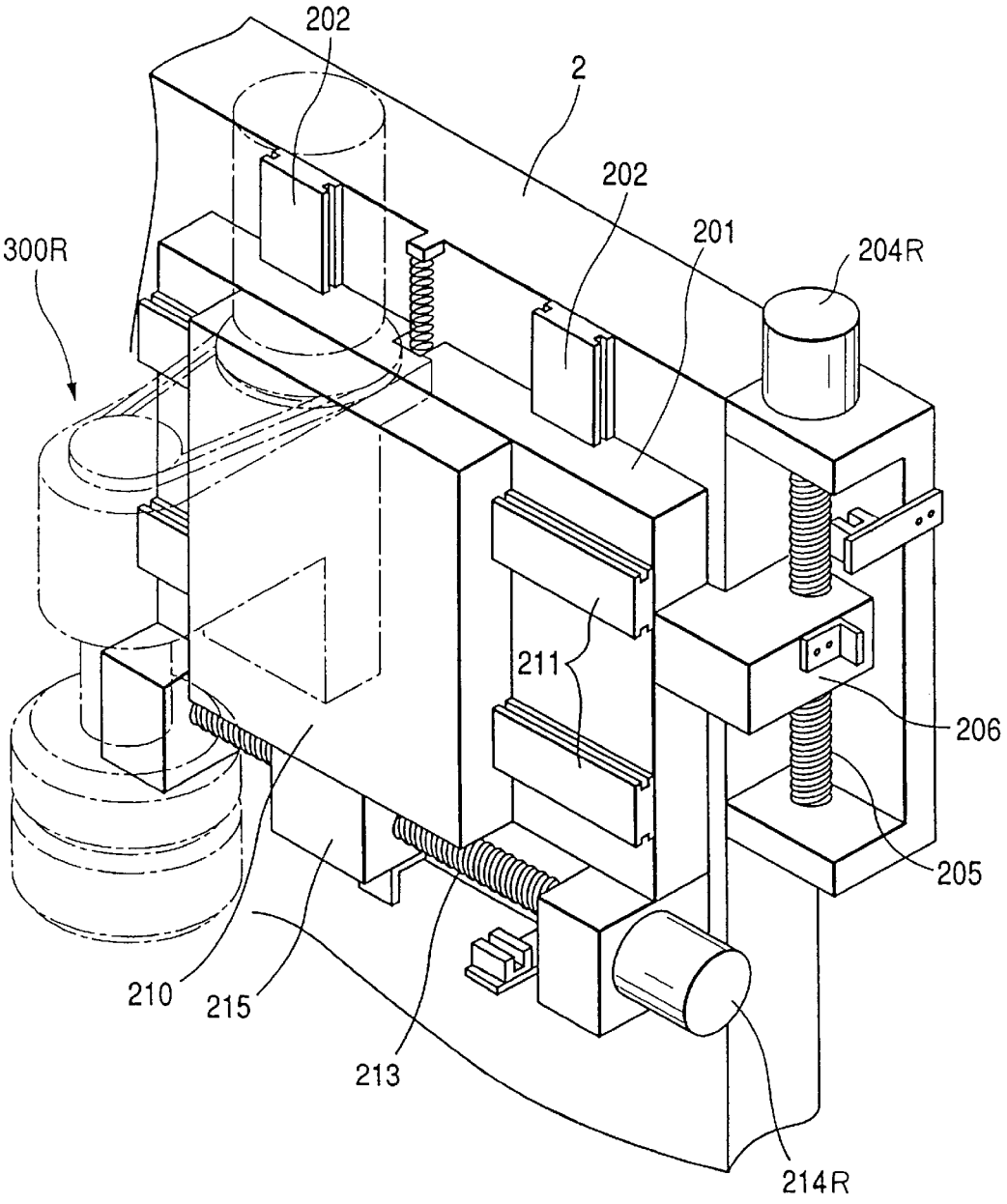
FIG. 4 is a view illustrating the mechanism for moving a lens grinding part 300R.

FIG. 4 illustrates a mechanism for moving the right lens grinding part 300R. (Since a moving mechanism for the left lens grinding part 300L is symmetrical with that for the right lens grinding part 300R, it will not be described.) A vertical slide base 201 is vertically slidable along two guide rails 202 that are fixed to the front surface of the sub-base 2. A nut block 206 is fixed to the vertical slide base 201. When a ball screw 205 coupled to the rotating shaft of the pulse motor 204R is rotated, the vertical slide base 201 is moved in the vertical direction together with the nut block 206.

Reference numeral 210 denotes a horizontal slide base to which the lens grinding part 300R is fixed. The horizontal slide base 210 is slidable in the horizontal direction along two slide guide rails 211 that are fixed to the front surface of the vertical slide base 201. A mechanism for moving the horizontal slide base 210 is basically the same as the above-described moving mechanism for the vertical slide base 201. The pulse motor 214R rotates the ball screw 213, so that the horizontal slide base 210 fixed to the nut block 215 is moved accordingly in the horizontal direction along the guide rails 211.

<Lens Grinding Part>

Figure 5:
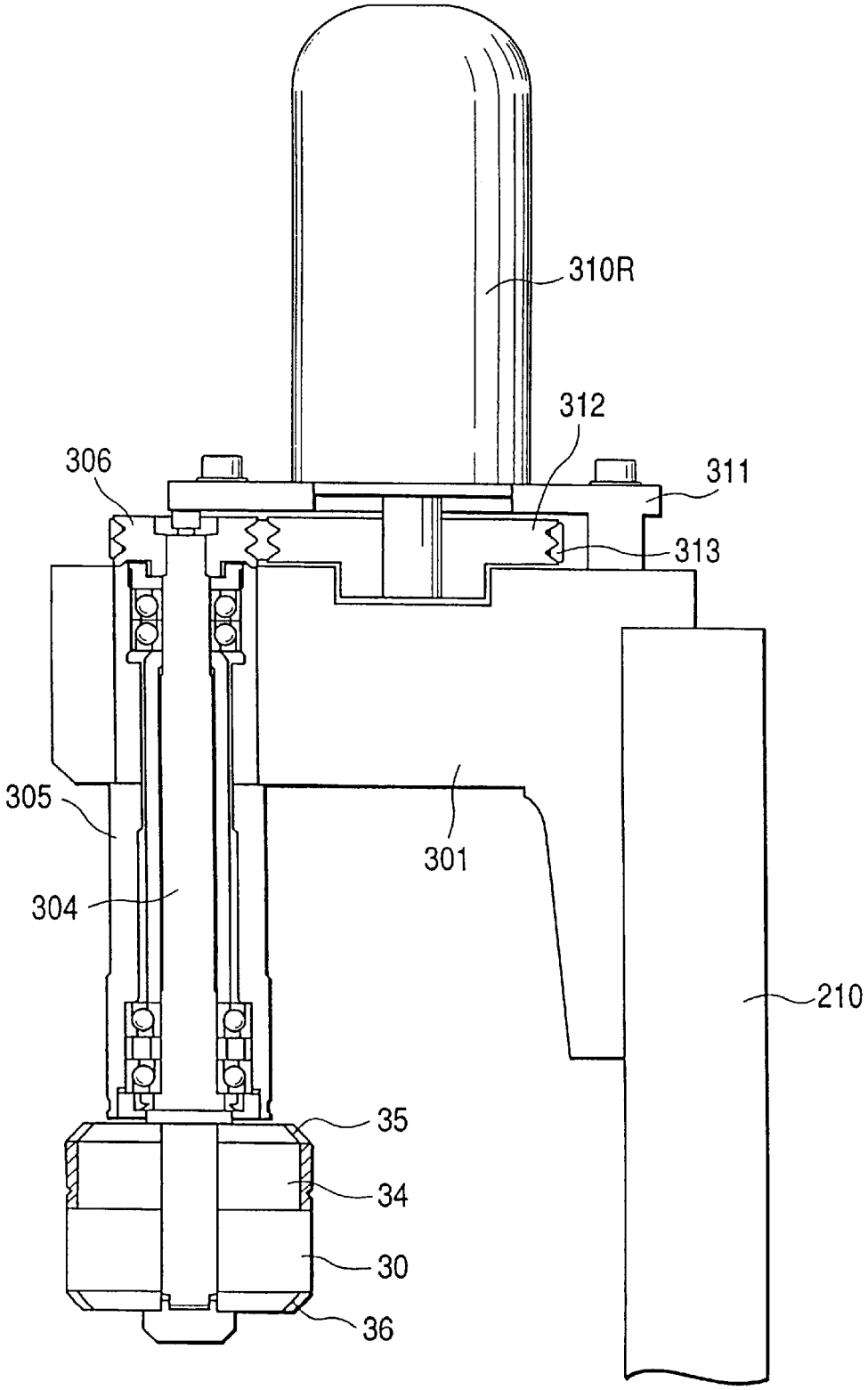
FIG. 5 is a sectional side view illustrating the configuration of the lens grinding part 300R.

FIG. 5 is a side sectional view showing the structure of the right lens grinding part 300R. A shaft support base 301 is fixed to the horizontal slide base 210. A housing 305 is fixed to the front portion of the shaft support base 301, and rotatably holds therein a vertically extending rotary shaft 304. A group of grinding wheels including a rough grinding wheel 30 and so on are mounted on the lower portion of the rotary shaft 304. A servo motor 310R is fixed to the top surface of the shaft support base 301 through a mounting plate 311, so that the rotational force of the servo motor 310R is transmitted via a pulley 312, a belt 313 and a pulley 306 to the rotary shaft 304, thereby rotating the group of the grinding wheels.

Since the left lens grinding part 300L is symmetrical with the right lens grinding part 300R, its structure will not be described.

<Lens Thickness Measuring Section>

Figure 6:
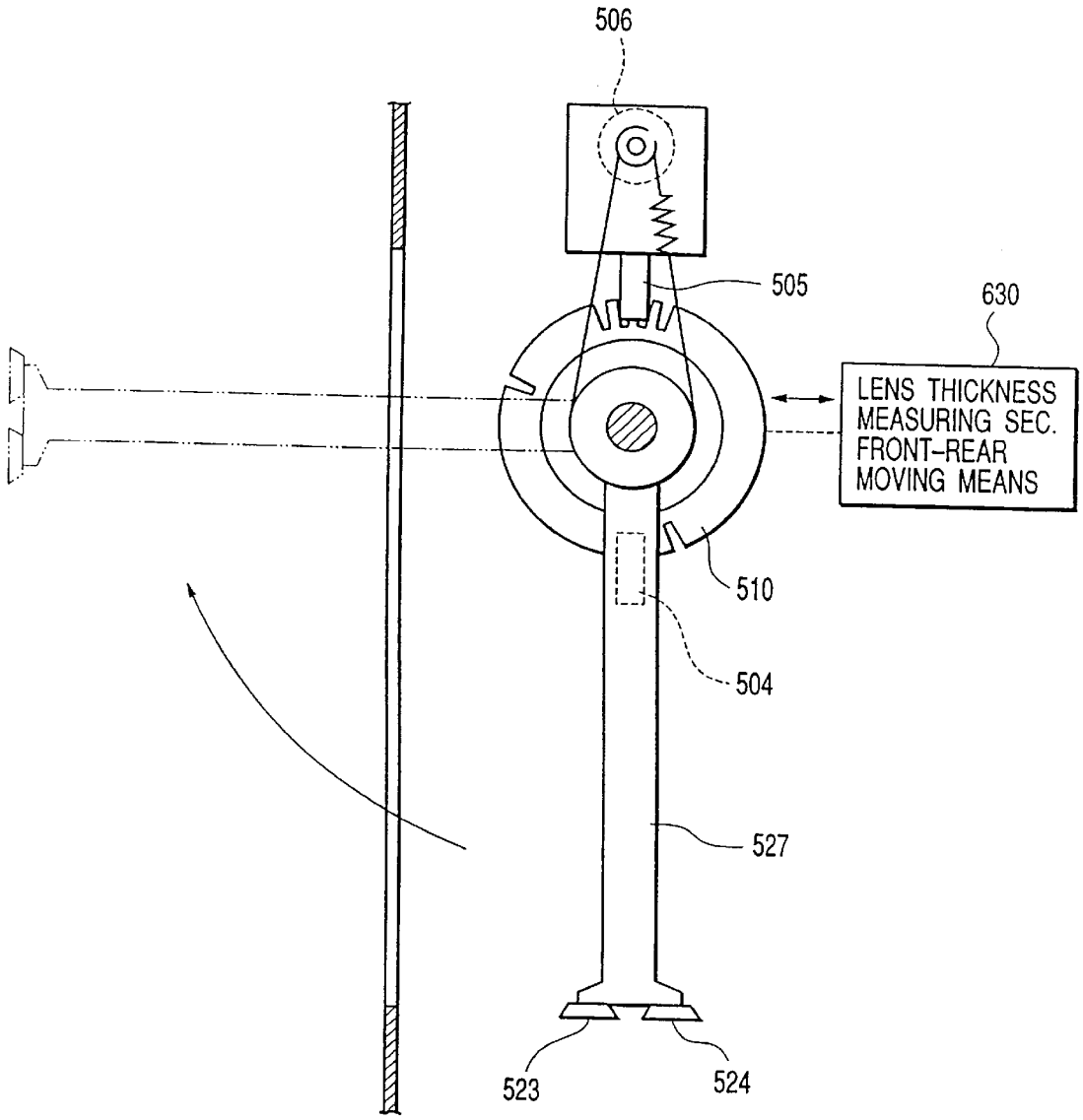
FIG. 6 is a diagram illustrating a lens thickness measuring section.

FIG. 6 illustrates the lens thickness measuring section 400 (FIG. 1). The lens thickness measuring section 400 includes a measuring arm 527 having two feelers 523 and 524, a rotation mechanism such as a DC motor (not shown) for rotating the measuring arm 527, a sensor plate 510 and photo-switches 504 and 505 for detecting the rotation of the measuring arm 527 to thereby allow control of the rotation of the DC motor, a detection mechanism such as a potentiometer 506 for detecting the amount of rotation of the measuring arm 527 to thereby obtain the shapes of the front and rear surfaces of the lens. The configuration of the lens thickness measuring section 400 is basically the same as that disclosed in Japanese Unexamined Patent Publication No. Hei. 3-20603 and U.S. Pat. No. 5,333,412 filed by or assigned to the present assignee, which are referred to for details of the lens thickness measuring section 400. A difference from that disclosed in Japanese publication 3-20603 is that the lens thickness measuring section 400 of FIG. 6 is so controlled as to move in front-rear direction (indicated by arrows in FIG. 6) relative to the lens grinding apparatus by a front-rear moving means 630 based on edge processing data.

In addition, the lens thickness (edge thickness) measurement is performed in the following manner. The measuring arm 527 is rotated, that is elevated, so that the feeler 523 is brought into contact with the lens front refraction surface. While keeping the feeler 523 in contact with the lens front refraction surface, the lens is rotated as well as the lens thickness measuring section 400 is controlled to move forward or backward by the front-rear moving means 630, so that the shape of the lens front refraction surface (on the edge of the lens to be formed) is obtained. Then, the shape of the lens rear refraction surface (on the edge of the lens to be formed) is obtained similarly by rotating the lens and by moving the lens thickness measurement section 400 while keeping the feeler 524 in contact with the lens rear refraction surface. Based on the shapes of the lens front and rear refraction surfaces, the lens thickness (edge thickness) is obtained. The lens thickness is measured such that the measuring arm 527 is rotated upward from its lower initial position and the feelers 523 and 524 are respectively brought into contact with the front and rear refraction surfaces of the lens. Therefore, it is preferable that the rotary shaft of the measuring arm 527 be equipped with a coil spring or the like which cancels out the downward load of the measuring arm 527.

<Control System>

Figure 7:
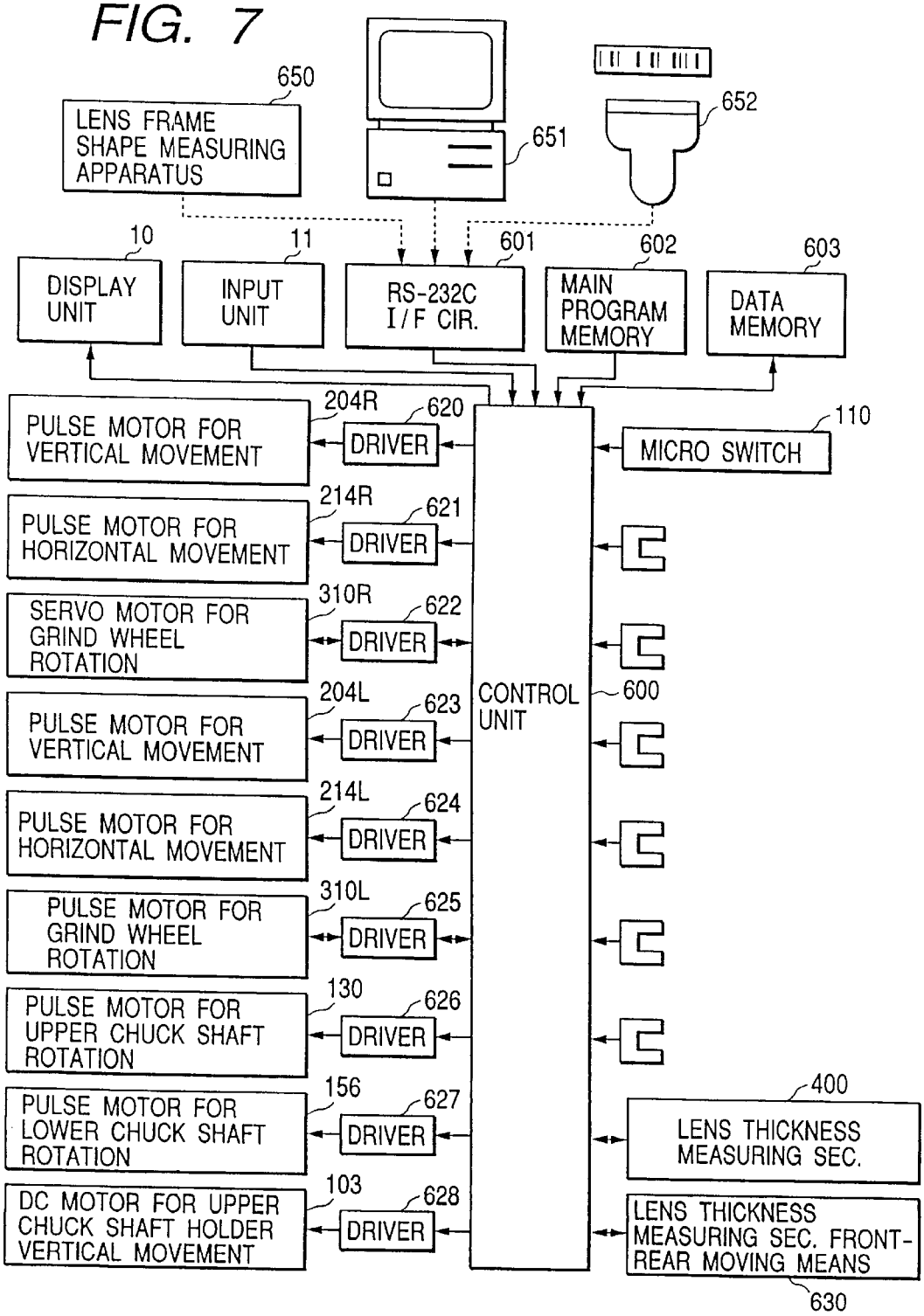
FIG. 7 is a schematic block diagram showing a control system of the apparatus of the embodiment.

FIG. 7 is a block diagram showing a general configuration of a control system of the lens grinding apparatus. Reference character 600 denotes a control unit which controls the whole apparatus. The display unit 10, input unit 11, micro switch 110, and photosensors are connected to the control unit 600. The motors for moving or rotating the respective parts are connected to the control unit 600 via drivers 620–628. The drivers 622 and 625, which are respectively connected to the servo motor 310R for the right lens grinding part 300R and the servo motor 310L for the left lens grinding part 300L, detect the torque of the servo motors 310R and 310L during the processing and feed back the detected torque to the control unit 600. The control unit 600 uses the torque information to control the movement of the lens grinding parts 300R and 300L as well as the rotation of the lens.

Reference numeral 601 denotes an interface circuit which serves to transmit and receive data. An eyeglass frame shape measuring apparatus 650 (see U.S. Pat. No. 5,333,412), a host computer 651 for managing lens processing data, a bar code scanner 652, etc. may be connected to the interface circuit 601. A main program memory 602 stores a program for operating the lens grinding apparatus. A data memory 603 stores data that are supplied through the interface circuit 601, lens thickness measurement data, and other data.

Operation

Figure 8:
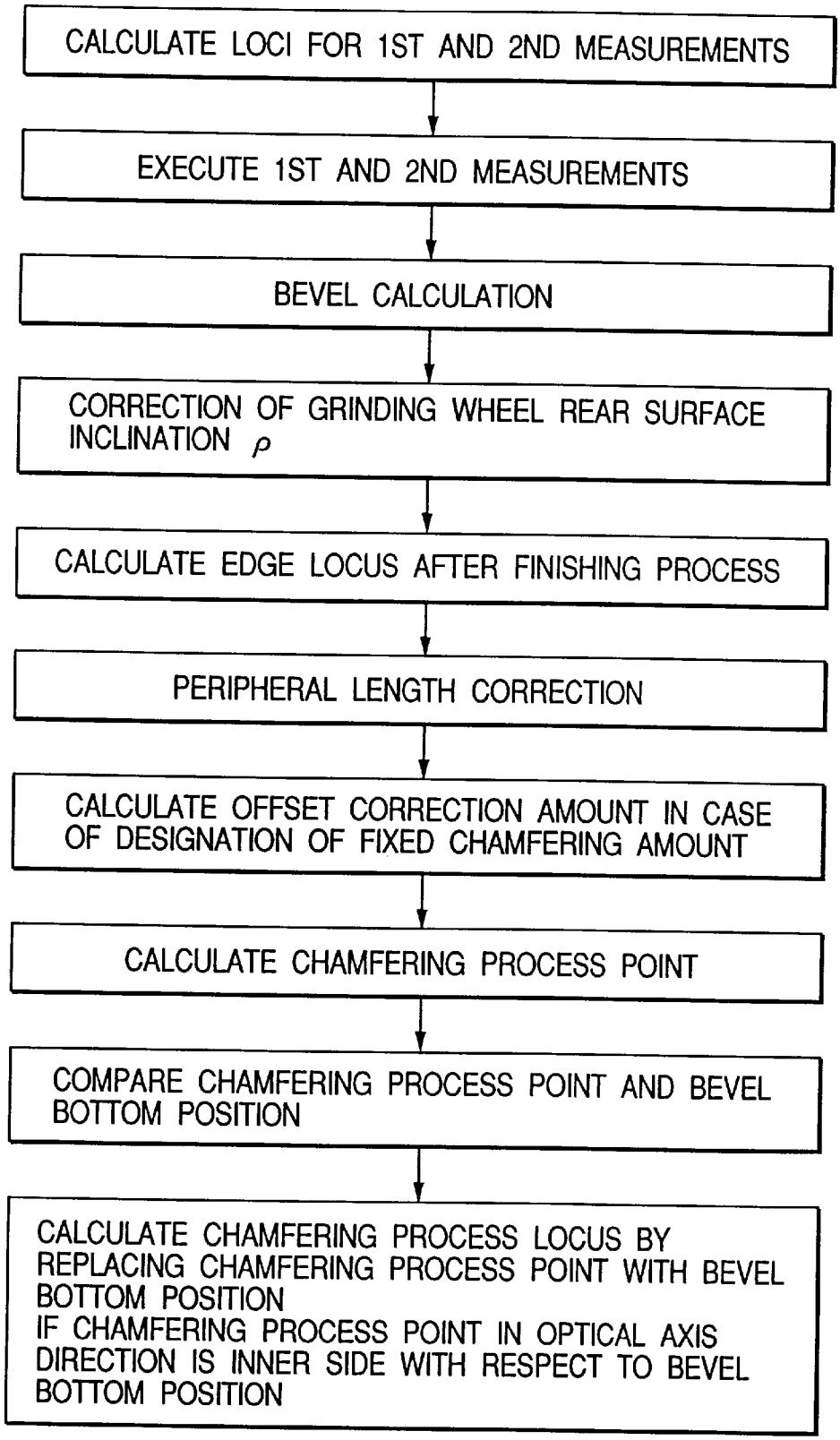
FIG. 8 is a flowchart illustrating a method of calculating a chamfering process locus.

Next, a method of calculating the process locus in the chamfering process will be described (see the flowchart of FIG. 8). First, an edge position locus after the finishing process is obtained, and the chamfering process locus is then calculated on the basis of the edge position locus.

(I) Calculation of edge position locus

When a chamfering process is to be performed on each of the rear and front refraction surfaces of the lens, the edge position locus is obtained in each of the surfaces. Hereinafter, the case where the process is performed on the rear surface of the lens will be described.

When the edge position locus is to be calculated, two-dimensional process data with respect to the rotation center of the lens are obtained on the basis of the frame shape data obtained by the eyeglass frame shape measuring apparatus 650 and the layout data input through the input unit 11 (processes such as correction of warpage of the frame may be added). By using the lens thickness measuring section 400, the lens shape is measured two times on the basis of the process data and in accordance with different measurement loci.

In the first measurement of the lens shape, the measurement is performed in accordance with the locus of the position of the bevel apex (in the specification, this is referred to as the reference shape) to be formed in the lens. This measurement locus can be obtained from the two-dimensional process data based on the frame shape data and the layout data.

The second measurement is performed in accordance with the shape (the locus) of the bevel bottom (the portion where the bevel slope and the bevel shoulder intersect each other). This measurement locus in this case can be obtained in the following manner.

Figure 9:
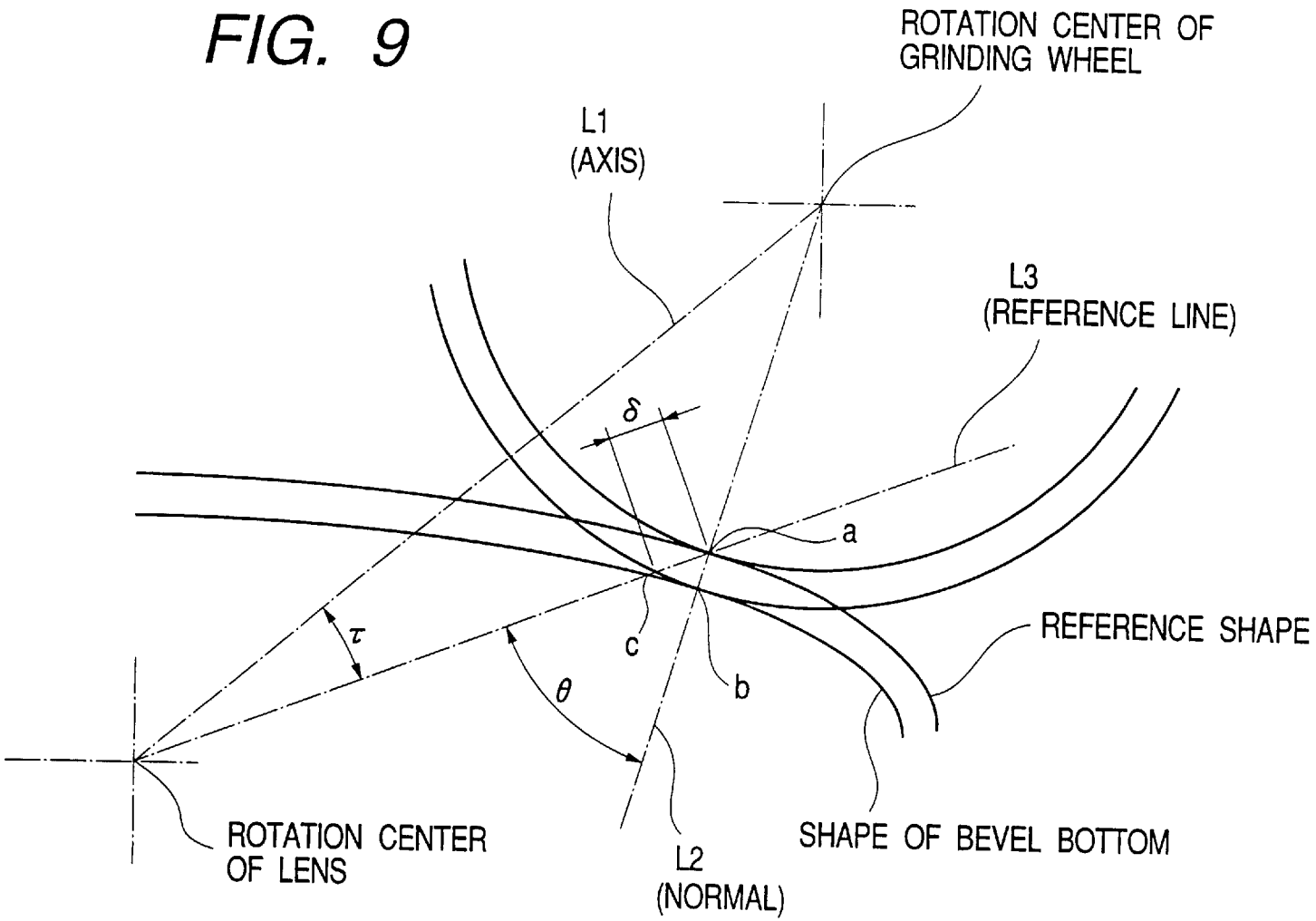
FIG. 9 is a diagram illustrating the calculation of a measurement locus in a second measurement.

As shown in FIG. 9, when a point a at the bevel apex (reference shape) is to be processed, the line connecting the rotation center of the lens and that of the grinding wheel is indicated as an axis L1, the line connecting the process point a and the rotation center of the grinding wheel is indicated as a normal L2, the line connecting the process point a and the rotation center of the lens is indicated as a reference line L3, and the followings are defined:

$\delta$=height of the bevel (the line segment ac) in the direction of the reference line L3, $\theta$=angle between the normal L2 and the reference line L3, $\gamma$=reference height of the bevel (the line segment ab, and already known from the shape of the bevel groove), and $\tau$=angle formed by the reference line L3 and the axis L1.

The position of the process point a can be obtained by a process correction calculation (basically identical with that described in U.S. Pat. No. 5,347,762) which calculates the axis-to-axis distance between the lens rotation center and the wheel rotation center during a process, from information indicative of the radius vector angle and length of the lens on the basis of the frame shape data and the layout data, and in correspondence with the radius vector angle (the lens rotation angle during a process). When the position of the process point a is once obtained, $\theta$ and $\tau$ are known.

Assuming that the angle formed by the line segments ab and bc of $\Delta$abc of FIG. 9 is approximately rectangular, the following is held:

$$\delta = \gamma / \cos\theta$$

By subtracting the bevel height $\delta$ from the reference shape in the direction of the reference line L3, the distance of the bevel bottom at the process point a can be obtained. When the distance is calculated at each places in correspondence with the radius vector angle, the measurement locus in the second measurement can be obtained.

When the lens shape is once measured, it is possible to obtain three-dimensional bevel curve locus data which are to be applied to the lens edge, on the basis of information indicative of the lens shape and in accordance with a predetermined program. As for this calculation, there have been proposed several methods such as that a curve is determined from front and rear surface curves, that the edge thickness is divided, and that the two methods are combinedly performed (the movement or the selection may be performed in response to an input operation by the optician). For details of this calculation, reference may be had to commonly assigned U.S. Pat. No. 5,347,762, etc.

When the bevel curve locus data are obtained, the edge locus after the beveling process is obtained on the basis of the data and the edge position information (the edge position locus) obtained by the two lens shape measurements described above. When the edge locus is to be obtained, deviation of the edge position is corrected with respect to the inclination angle which is provided to the finishing grinding wheel in order to form a bevel shoulder.

Figure 10:
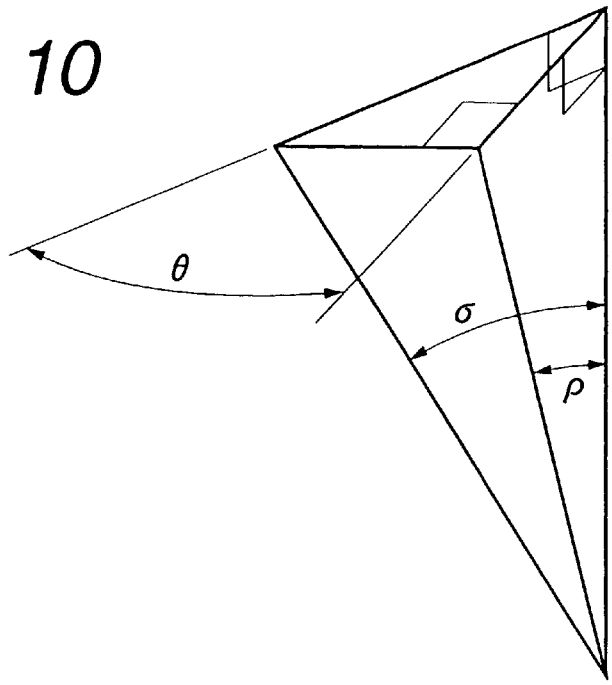
FIG. 10 is a diagram illustrating the calculation of a correction angle $\sigma$ of a rear surface inclination angle $\rho$ in a finishing grinding wheel.
Figure 16:
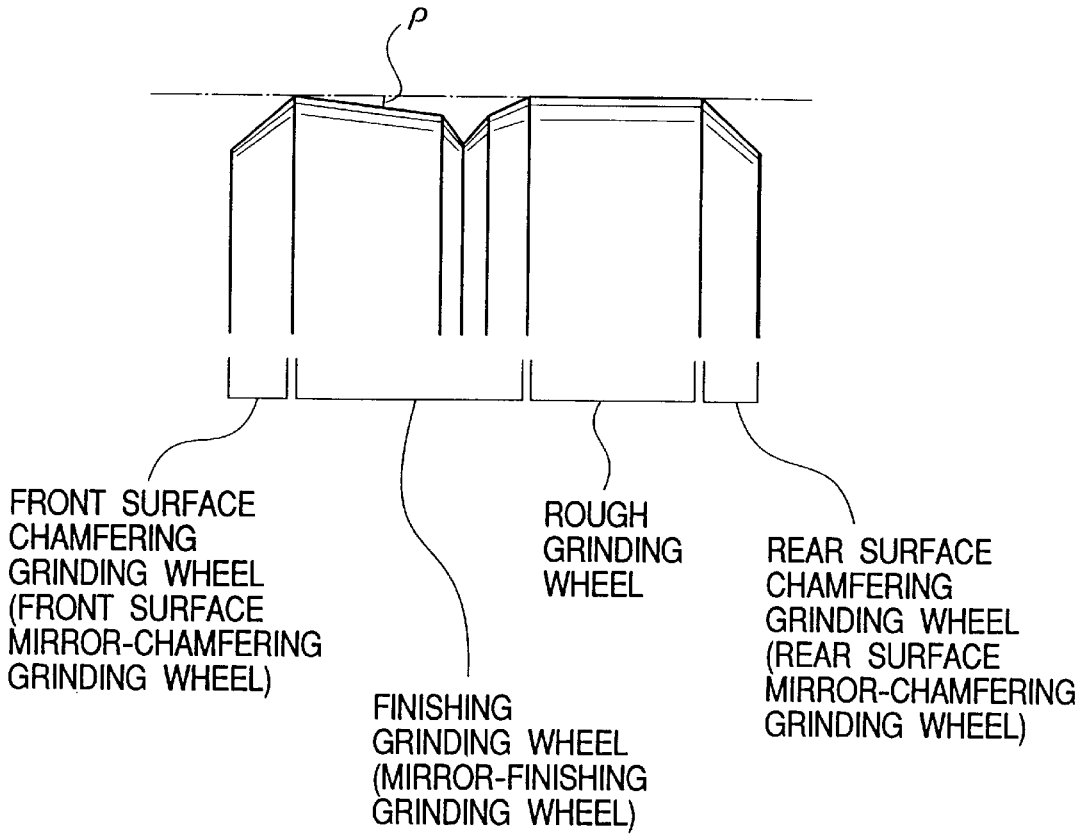
FIG. 16 is a side view for explanation about a rear surface inclination angle ρ of a finishing grinding wheel.

First, a correction angle for the lens rear surface inclination with respect to the rear surface inclination angle ρ (this value is previously known and stored in the main program memory 602) of the finishing grinding wheel (as shown in FIG. 16) is calculated. When a lens is processed at the rear surface inclination angle ρ of the finishing grinding wheel, the inclination angle of the lens bevel shoulder in the direction of the normal L2 becomes as it is to the inclination angle ρ. In order to obtain the edge locus in the direction of the reference line L3, however, a correction angle must be considered for the section shape in the direction of the reference line L3. From FIG. 10, the correction angle σ for this purpose is obtained as:

$$\sigma = \text{arctaan}\ (\tan \rho / \cos \theta)$$

This correction angle σ is obtained for each place in accordance with the radius vector angle.

Figure 11:
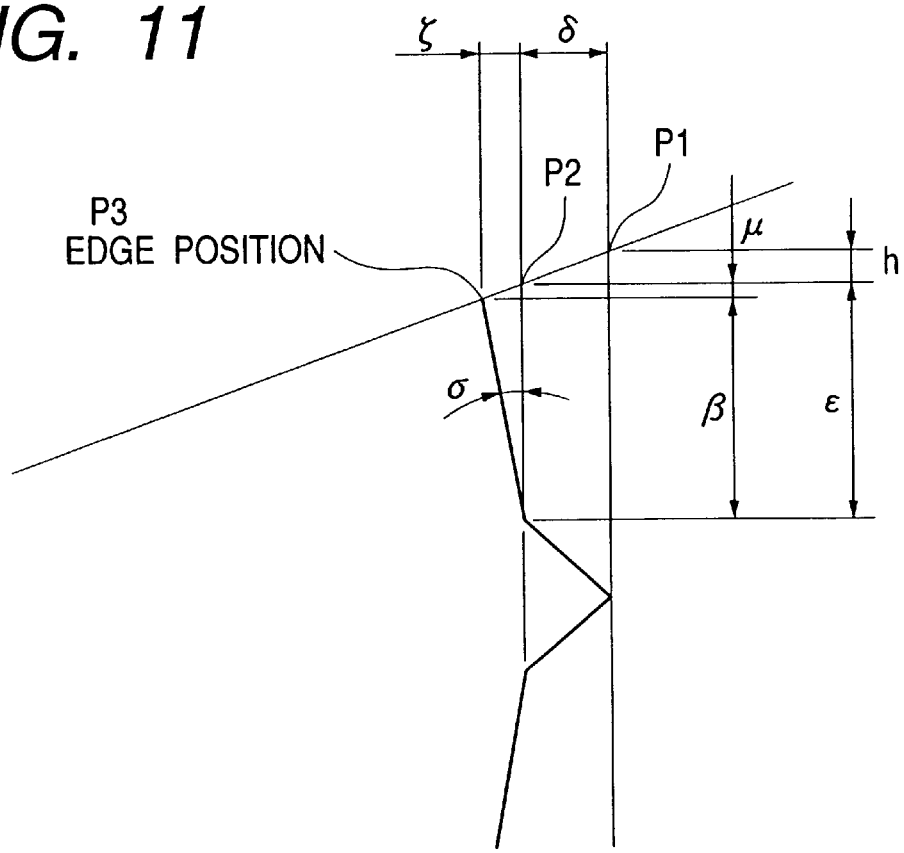
FIG. 11 is a diagram illustrating the calculation of an edge position P3 after a finishing process.

Next, as shown in FIG. 11, the section shape in the direction of the reference line L3 is considered in accordance with the correction angle σ of the rear surface inclination, and the edge position P3 of the lens rear surface after the beveling process is obtained. In FIG. 11, P1 denotes the edge position obtained in the first measurement of the lens edge position, and P2 denotes the edge position obtained in the second measurement. In this case, h of FIG. 11 is obtained from the result of the measurement of the lens edge position, and ϵ from the result of the second measurement (the measurement result at the bevel bottom) and the bevel calculation result. When the rear surface is approximately considered as a straight line, therefore, a correction amount $\mu$ in the optical axis direction of the lens, and a correction amount ξ in the radial direction of the lens are expressed as follows:

[Ex. 1]

When the correction amounts are obtained for each place in accordance with the radius vector angle, information of the edge locus on the side of the rear surface after the beveling process is obtained.

Figure 12A:
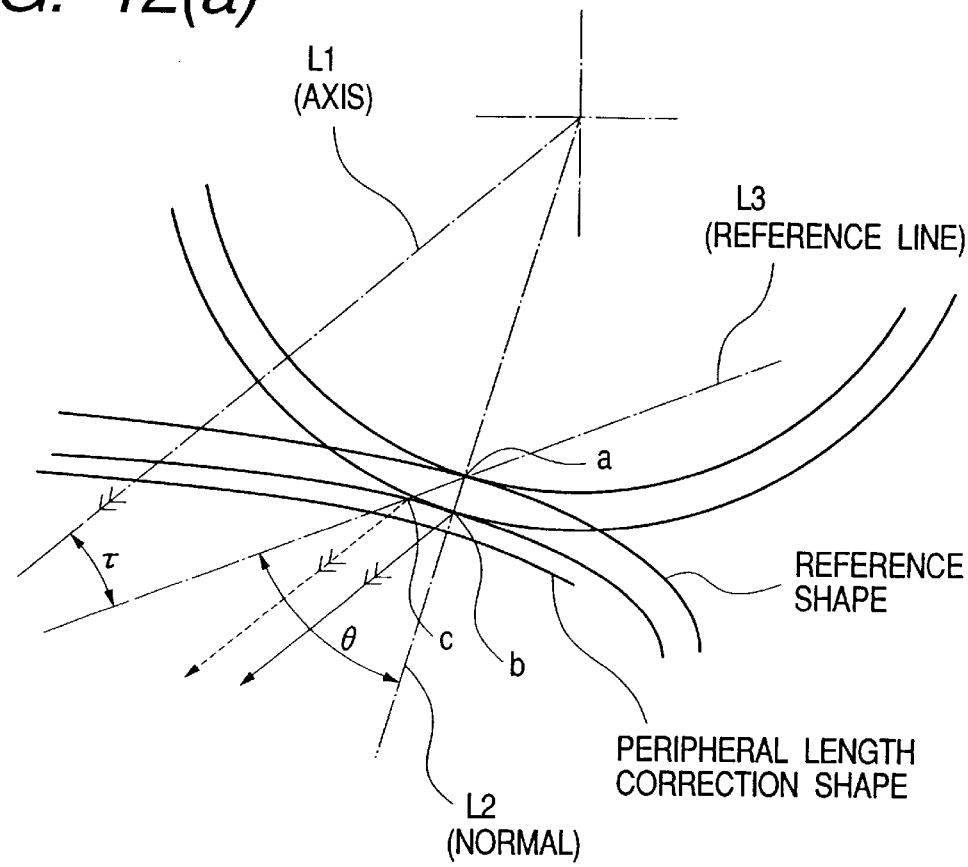
FIG. 12*a* and 12*b* are diagrams illustrating a change due to a peripheral length change and the calculation of a correction amount$\omega$ in the direction of a reference line L3 respectively.
Figure 12B:
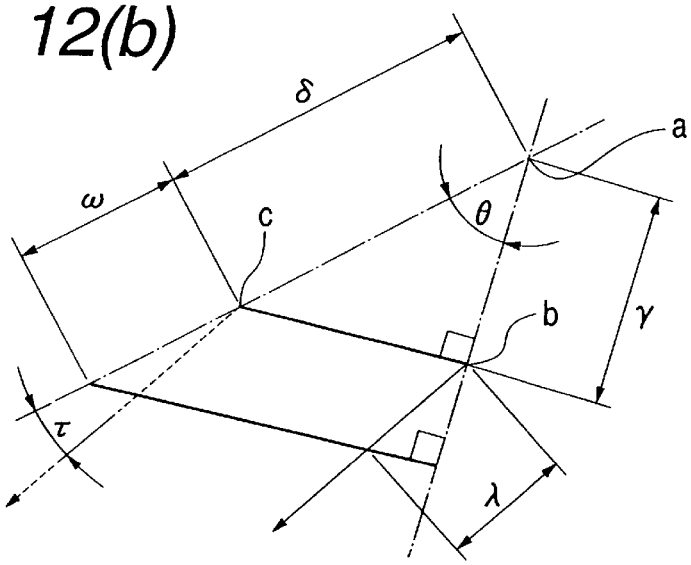

As described in U.S. Pat. No. 5,347,762, when a lens which has undergone a beveling process is to be mounted to an eyeglass frame, it is preferable to correct the position of the bevel apex so that the curve locus of the eyeglass frame substantially coincides in peripheral length with the bevel curve locus. In the correction (hereinafter, referred to as peripheral length correction), the peripheral length of the bevel curve locus is approximately obtained by calculating distances among the bevel curve locus data obtained in the bevel calculation on the basis of the data, and summing the distances. The correction amount can be obtained from the thus obtained peripheral length, and the peripheral length of the eyeglass frame shape which is similarly obtained from the radius vector information of the frame shape. The calculation of the edge locus after the beveling process in the case where the peripheral length correction is performed will be described. In the above, all the correction calculations are performed on the reference line L3. The shape change due to the peripheral length correction occurs in the direction of the axis L1 (see FIG. 12(*a*)). Consideration will be made with substituting the shape change due to the peripheral length correction for that in the reference line L3. It is assumed that, as shown in FIG. 12(*b*), a point b of the bevel bottom before the peripheral length correction is corrected in the direction of the axis L1 by a peripheral length correction amount λ, and a point c also is corrected in the direction of the axis L1 at the point b. In this case, a correction amount ω in the direction of the reference line L3 can be approximately obtained by:

[Ex. 2]

Figure 13:
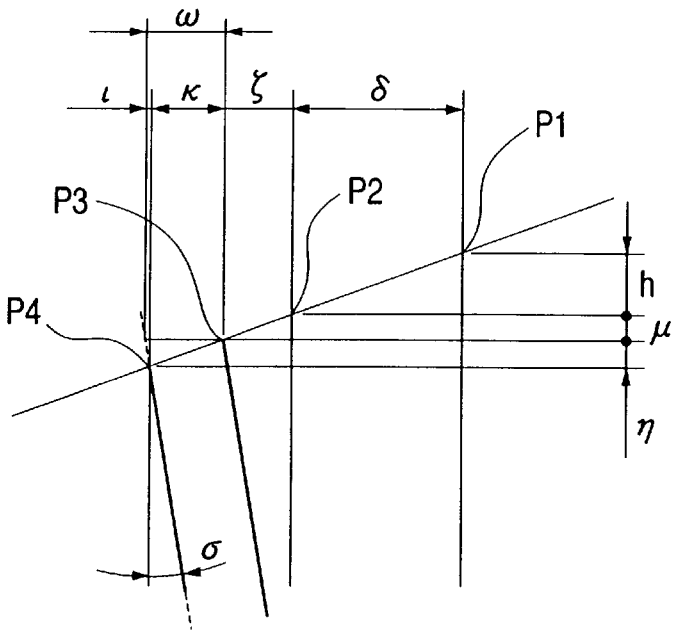
FIG. 13 is a diagram illustrating the calculation of the edge position after a finishing process in the case where a peripheral length correction is performed.

In order to obtain the edge locus after the beveling process due to the peripheral length correction, the section shape shown in FIG. 13 and in the direction of the reference line L3 will be considered in the same manner as described above. Assuming that the edge position P3 is shifted to P4 as a result of the peripheral length correction, when the correction amount in the radial direction of the lens is indicated by κ and that in the optical axis direction of the lens is indicated by η, these correction amounts are as follows:

[Ex. 3]

In the case where the peripheral length correction is performed, therefore, the correction amounts of the edge position after the final beveling process are expressed as follows:

[Ex. 4]

When the correction amounts are obtained for each place in accordance with the radius vector angle, information of the edge locus on the side of the lens rear surface in the case where the peripheral length correction is performed is obtained.

(II) Calculation of chamfering process locus

Next, the calculation of the chamfering process locus which is performed during the chamfering process in order to visually uniformalize the chamfer shape will be described with reference to FIG. 14. Even when the edge locus is obtained as described above and a fixed chamfering amount from the edge end (P4) in the bevel direction is designated (an offset of a fixed amount is applied), the length of the chamfered slope after chamfering (hereinafter, the length is referred to as chamfering width) is changed by influence of the rear surface curve, with the result that the chamfering is visually recognized not to be uniformly performed. In order to visually uniformalize the chamfering width in the case where a fixed chamfering amount is designated, therefore, the chamfering process locus is obtained so that the length of the slope after chamfering is uniform irrespective of the radius vector angle.

Figure 14:
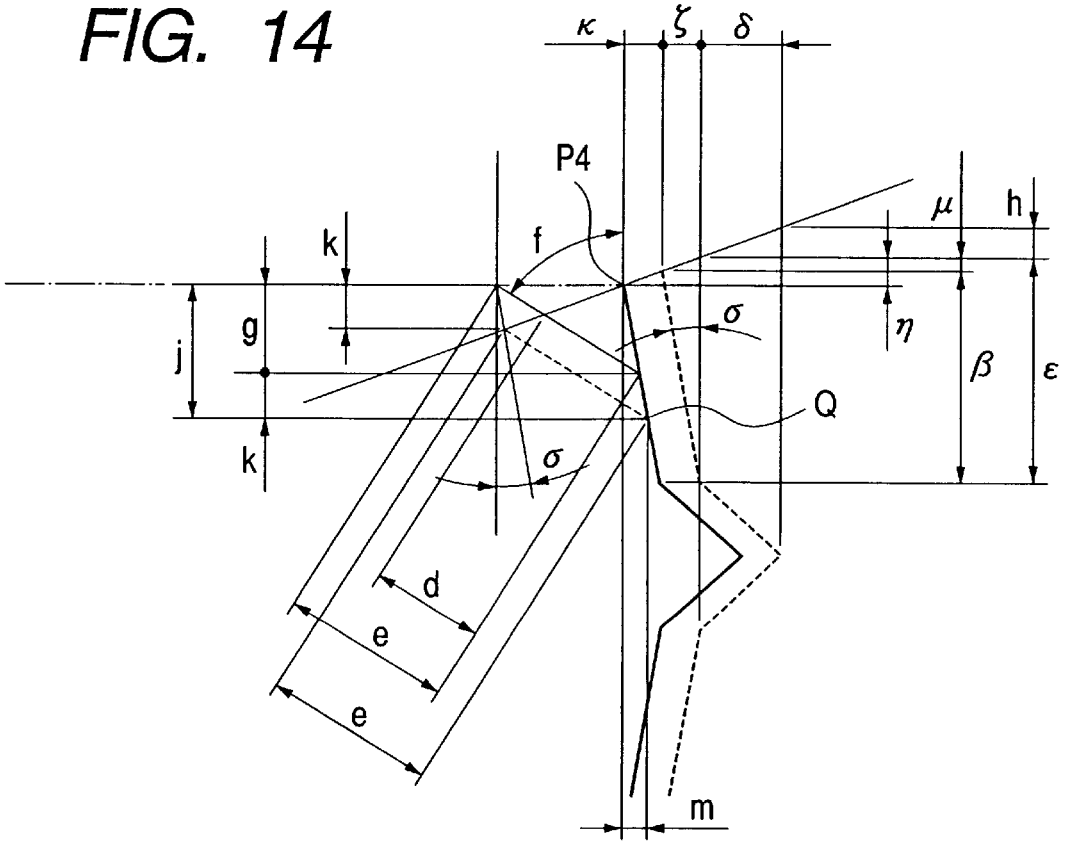
FIG. 14 is a diagram illustrating the calculation of the chamfering process locus.

In FIG. 14, g denotes an offset component of the chamfering amount, j denotes an offset amount after correction, f denotes a correction angle of the inclination angle F of the chamfering grinding wheel (a previously known value, and, in the embodiment, 45 degrees) in the direction of the reference line L3, and e denotes a chamfering width in the case where the rear surface of the lens is flat. The chamfering width becomes equal in size to the chamfering width d because of the rear surface curve. In a method of uniformalizing the chamfering width, an offset correction amount k is obtained so as to attain the chamfering width which is equal to that in the case where the rear surface of the lens is flat. In order to perform the method, the correction angle f is first obtained. In the same manner as that of obtaining the correction angle σ in FIG. 10, the correction angle is obtained by:

$$f = \arctan(\tan F / \cos\theta).$$

From the figure, the offset correction amount k is obtained as follows:

[Ex. 5]

This method is based on the approximation expression. When the offset component g is largely increased, therefore, the error is increased. From the view point of visual uniformalization, when the offset component g is greater than 1 mm, it is preferable to obtain the offset correction amount k while setting g to be 1 (g=1). When the correction angle σ is sufficiently small, the offset correction amount may be expressed as follows:

[Ex. 6]

(in the correction on the side of the front surface of the lens, particularly, the influence is very small).

From the above, it will be seen that the position of a chamfering process point Q in the optical axis direction with respect to the edge position P4 shown in FIG. 14 can be obtained by an addition of g+k. For the position of the chamfering process point Q in the radial direction of the lens with respect to the edge position P4, a correction amount m can be obtained by:

$$m = j \cdot \tan\sigma.$$

The thus obtained position of the chamfering process point Q is information which is obtained without considering the position of the bevel bottom. In the case of a beveling process, the chamfering process must be performed so as not to interfere with the bevel. To comply with this, a process is performed in which the position of the bevel bottom is obtained, the position is compared with the chamfering process point, and, if the chamfering process point Q in the optical axis direction is in the inner side with respect to the position of the bevel bottom, the bevel bottom position is substituted for the chamfering process point.

Figure 15:
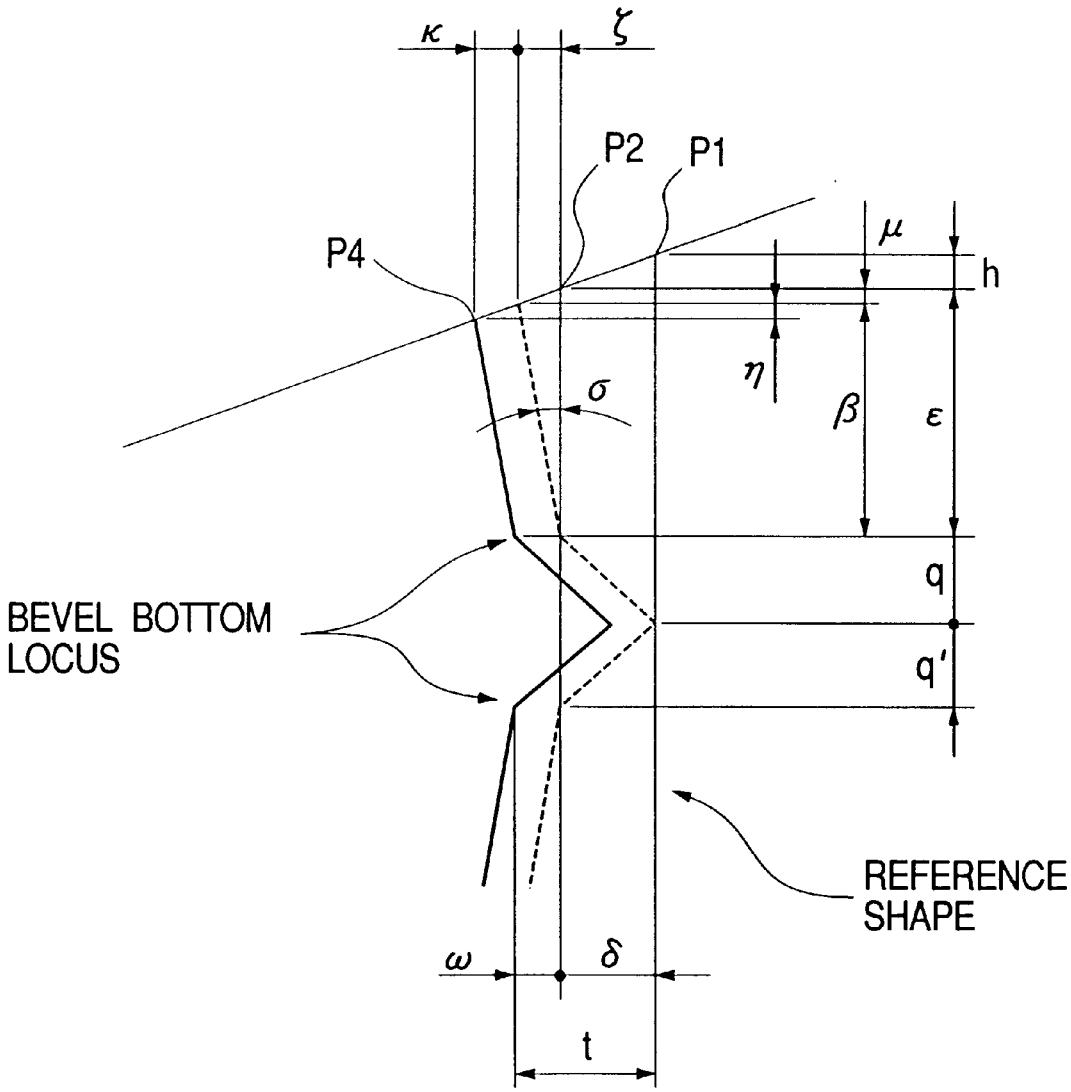
FIG. 15 is a diagram illustrating the calculation of a value of a bevel bottom position in a radial direction of the lens.

As shown in FIG. 15, the value of the bevel bottom position in the radial direction of the lens can be obtained by subtracting t=δ+ω from the reference shape (this is equal to that obtained by subtracting ω from the locus of the second measurement). The value of the bevel bottom position in the optical axis direction of the lens is obtained by using q and q' obtained by splitting the bevel apex. The q and q' are obtained from the shape of the bevel groove of the finishing grinding wheel.

In this way, the chamfering process point Q and the position of the bevel bottom are obtained for the whole periphery in accordance with the radius vector angle, and the chamfering process locus in which the chamfering process does not interfere with the bevel can be obtained. The chamfering process locus on the side of the front surface of the lens can be obtained in the same method.

Also in a plane process in which a beveling process is not performed, the chamfering process locus can be obtained in a basically same concept.

Next, an actual processing operation will be briefly described. The optician measures the shape of an eyeglass frame (template) by using the eyeglass frame shape measuring apparatus 650, and inputs the measured shape. Thereafter, the optician inputs layout data such as the PD value of the user and the height of the optical center are input with respect to the lens shape based on the eyeglass frame data. Furthermore, a process mode such as the beveling process, the plane process, or a mirror-polish process is input, and instructions relating to the chamfering amount is input. The input of the chamfering amount can be performed by means of a ratio (referred to as a chamfering ratio) which is used for splitting the width (the width in the optical axis direction) of the bevel shoulder extending from the bevel bottom to the edge position, in the whole periphery, and the offset amount g shown in FIG. 14. When both the instructions of the chamfering ratio and offset amount are concurrently used, the chamfering process position obtained by splitting the width of the bevel shoulder on the basis of the input ratio is shifted by the amount corresponding to the instructions of the offset amount. When the whole periphery of the edge is to be uniformly chamfered, only the offset amount g is input. Hereinafter, the case where the beveling process and the chamfering process are performed will be described.

The optician performs predetermined processes on the lens to be processed and places the lens on the chuck shaft 152. When preparation for the process is completed, the START switch of the input unit 11 is depressed to start the operation of the apparatus.

In response to START signal, the control unit 600 controls the operations of the front-rear moving means 630 and lens thickness measuring section 400, and the rotation of the chucked lens to be processed. Two measurements, i.e., the first and second measurements are performed on each of the rear and front refracting surfaces of the lens on the basis of the layout information and the lens frame shape. On the basis of the measurement results, the apparatus performs calculations of the edge and peripheral length correction, so that the edge locus information and the chamfering process locus information are obtained as described above.

When the calculations are completed, a rough-grinding process, the beveling process, and the chamfering process are automatically performed in a sequential manner. In the rough-grinding process, both the right and left rough grinding wheels 30 are moved to the level of the lens to be processed, and the lens grinding parts 300R and 300L are then slid toward the lens to be processed. The lens is gradually ground in two directions by moving the right and left lens grinding parts 300R and 300L which are rotating, toward the lens to be processed. The movement amounts of the right and left rough grinding wheels 30 toward the lens are independently controlled on the basis of the process data.

When the rough-grinding process is ended, the process advances to the beveling process. The control unit 600 controls the movements of the finishing grinding wheel 31 (or the finishing grinding wheel 34) in the height of the bevel groove and the lens direction on the basis of beveling process data stored in the data memory 603, thereby performing the beveling process.

When the beveling process is ended, the process advances to the chamfering process. The control unit 600 controls the movements of the front surface chamfering grinding wheel 32 and the rear surface chamfering grinding wheel 33 (or the chamfering grinding wheels 35 and 36 are used) in the vertical directions and the radial direction of the lens on the basis of the chamfering process data stored in the data memory 603. When only the offset amount g is designated, the correction is performed so that the length of the chamfered slope is uniform irrespective of the radius vector angle, and hence the chamfering is visually recognized not to be uniformly performed, thereby improving the appearance.

In the embodiment described above, the edge of a lens is measured by two measurements, i.e., the first and second measurement on the whole periphery. Since the inclination angle of a lens is not abruptly changed, the edge may be measured at intervals of, for example, 15 degrees, and the measurement results may be smoothly interpolated. If the lens data can be obtained from other means, the data may be used. That is to say, lens data of the eyeglass lens or edge position information obtained by measuring different positions with respect to the radius vector may be used as a position variation information to calculate edge positions after a finishing process.

As described above, according to the invention, a chamfering process can be easily performed and the chamfered shape can be finished to a satisfactory one.

[Ex. 1]

$$\beta\tan\sigma = \mu\frac{\delta}{h} \quad \beta = \varepsilon - \mu$$

optical axis direction $$\mu = \frac{\varepsilon\tan\sigma}{\frac{\delta}{h} + \tan\sigma}$$

Radical direction $$\zeta = \mu\frac{\delta}{h}$$

[Ex. 2]

$$\omega = \frac{\gamma + \lambda\cos(\theta - \tau)}{\cos\theta} - \delta$$

[Ex. 3]

$$\kappa = \frac{\omega\delta}{h\tan\sigma + \delta}$$

$$\eta = \kappa\frac{h}{\delta}$$

[Ex. 4]

Radical direction $$\zeta + \kappa = \mu\frac{\delta}{h} + \frac{\omega\delta}{h\tan\sigma + \delta} = \frac{\varepsilon\tan\sigma + \omega}{\frac{h}{\delta}\tan\sigma + 1}$$

Optical Axis direction $$\mu + \eta = \frac{\varepsilon\tan\sigma}{\frac{\delta}{h} + \tan\sigma} + \kappa\frac{h}{\delta} = \frac{\varepsilon\tan\sigma + \omega}{\frac{\delta}{h} + \tan\sigma}$$

[Ex. 5]

$$k = \frac{g(\tan f - \tan\sigma)}{\tan\sigma + \frac{\delta}{h}}$$

[Ex. 6]

$$k = \frac{gh}{\delta}\tan f$$

What is claimed is:

1. A lens grinding apparatus for grinding the periphery of an eyeglass lens, comprising:

data inputting means for inputting shape data of an eyeglass frame and layout data of an eyeglass lens to the eyeglass frame;

edge position measuring means for measuring first edge positions of front and rear surfaces of the eyeglass lens on the basis of the input data;

inclination angle storing means for storing an inclination angle of a processing surface of a finishing grinding wheel;

edge position calculating means for obtaining positions of edge corners on the front and rear surfaces of the eyeglass lens after a finishing process on the basis of the first edge position and the inclination angle of the finishing grinding wheel;

chamfering path calculating means for obtaining chamfering paths for the front and rear surfaces of the eyeglass lens based on the thus obtained positions of the edge corners;

a rotatable chamfering abrasive wheel having a chamfering surface for the front surface of the lens and a chamfering surface for the rear surface of the lens; and chamfering controlling means for relatively moving the chamfering abrasive wheel with respect to a lens holding shaft based on the thus obtained chamfering paths to chamfer the edge corners of the front and rear surfaces of the finished lens.

2. A lens grinding apparatus according to claim 1, wherein the first edge position includes points of bevel bottom suitable for obtaining a bevel processing path.

3. A lens grinding apparatus according to claim 1, wherein the edge position calculating means obtains a bevel processing path based on the first edge position corrects the inclination angle of the finishing grinding wheel based on a positional relationship between a process point of the finishing grinding wheel and a rotational center of the lens, and obtains the position of the edge corner from the corrected inclination anile and the bevel processing path.

4. A lens grinding apparatus according to claim 1, further comprising:

chamfering amount instructing means for instructing a chamfering amount, wherein the chamfering path calculating means obtains the chamfering path, based on (1) the instructed chamfering amount, (2) the thus obtained position of the edge corner, and (3) a corrected inclination angle corrected based on a positional relationship between a processing point of the finishing grinding wheel and a rotational center of the lens, so that a length of a chamfered slope is substantially constant.

5. A lens grinding apparatus according to claim 1, wherein the first edge position includes points of bevel bottom suitable for obtaining a first bevel processing path, and the edge position calculating means obtains a corrected bevel processing path based on a peripheral length difference between the shape data of the eyeglass frame and the first bevel processing path, corrects the inclination angle of the finishing grinding wheel based on a positional relationship between a processing point of the finishing grinding wheel and a rotational center of the lens, and obtains the position of the edge corner from the corrected inclination angle and the corrected bevel processing path.

* * * * *